United States Patent [19]

Heyne et al.

[11] Patent Number: 4,598,263

[45] Date of Patent: Jul. 1, 1986

[54] MAGNETICALLY OPERATED CIRCUIT BREAKER

[75] Inventors: Carl J. Heyne, Hampton Township, Allegheny County; Nicholas A. Tomasic, Plum; Jiing-Liang Wu, Murrysville, all of Pa.

[73] Assignee: Westinghouse Electric Corp., Pittsburgh, Pa.

[21] Appl. No.: 670,792

[22] Filed: Nov. 13, 1984

[51] Int. Cl.[4] ..... H01H 73/00; H01H 77/10

[52] U.S. Cl. ..... 335/14; 335/20

[58] Field of Search ..... 335/14, 16, 6, 20; 307/38

[56] References Cited

U.S. PATENT DOCUMENTS 4,223,288 9/1980 Stiner ..... 335/20

4,258,343 3/1981 Kussy ..... 335/6

*Primary Examiner*—Harold Broome

*Attorney, Agent, or Firm*—L. P. Johns

[57] ABSTRACT

A magnetically operated circuit breaker characterized by a circuit breaker structure including first and second separable contacts operable between open and closed positions, a releasable mechanism movable when released to a tripped position to effect automatic opening of the contacts, the first contact being connected to the releasable mechanism, the second contact being movable between open and closed positions of the first contact, and electromagnetic actuating means for moving the second contact between open and closed position in response to a control signal generated remotely from the circuit breaker.

6 Claims, 4 Drawing Figures

MAGNETICALLY OPERATED CIRCUIT BREAKER

BACKGROUND OF THE INVENTION

1. Field of the Invention:

This invention generally relates to circuit breakers and, more particularly, to a circuit breaker mechanism useful for remote power control for energy management, process control, motor, and lighting control.

2. Description of the Prior Art:

In recent years the cost of electric power has rapidly increased providing significant economic incentive to conserve energy. Concurrently, recent advances in electronic technology, and specifically minicomputer technology, have provided more sophisticated monitoring and control equipment which can be utilized to aid the energy conservation effort. One method of conserving electrical energy is to institute a control scheme which deenergizes specific electrical loads during preselected time periods. A very simple example of this conservation approach is to turn off office lights at a circuit breaker panel during non-working hours. This approach is used extensively, but has two inherent problems. First, the circuit breakers are not designed to function as on-off switches and secondly, manual operation is expensive and relatively inflexible.

These problems have been solved in the past by using a circuit breaker to provide fault protection and by adding a contactor in series with the breaker to function as the on-off switch. This traditional method solves the technical problems associated with the on-off operation since the circuit breaker mechanism (which is inherently limited to a moderate number of cycles) must operate only during fault conditions. The contactor, which is designed for cyclical duty, then performs the switching function. Contactors are traditionally supplied with solenoid actuators. These allow the switching function to be accomplished from a remote station, thereby increasing the flexibility of the system. The inherent disadvantage of this arrangement is the requirement for two costly items (circuit breaker and contactor) to perform the circuit protection and switching function.

In addition, these separate items require different mounting techniques and their installation requires cable routing that would not be required for a single device. The result of this additional complexity and cost has been to discourage the use of remotely operated energy management systems. The continued economic pressures to conserve electrical energy and the projected rapid growth in computerized energy management systems make the development of a remotely controlled magnet operated breaker timely.

SUMMARY OF THE INVENTION

In accordance with this invention a magnetically operated circuit breaker is provided which comprises an electrically insulating housing including a bottom wall, a circuit breaker structure within the housing and comprising first and second separable contacts operable between open and closed positions, the contacts being mounted on separate contact arms which arms extend in substantially parallel spaced locations to effect current limiting relationship between the arms, and releasable mechanism in an initial position and movable when released to a tripped position to effect automatic opening of the contacts and comprising a trip device for tripping the releasable mechanism when a predetermined current overload effects deflection of the device from a latched position, the first contact being connected to the releasable mechanism, the second contact being movable between open and closed positions of the first contact when the first contact is in the untripped position of releasable mechanism, and electromagnetic means for moving the second contact arm between open and closed positions of the first contact when untripped and in response to a control signal generated remotely from the circuit breaker.

The advantage of the device of this invention is that it provides means for controlling the state (open or closed) of a circuit breaker from a remote location without cycling the circuit breaker mechanism as well as avoiding excess wear of the circuit breaker mechanism which occurs when the mechanism is cycled repeatedly.

DESCRIPTION OF THE PREFERRED EMBODIMENT

Figure 1:
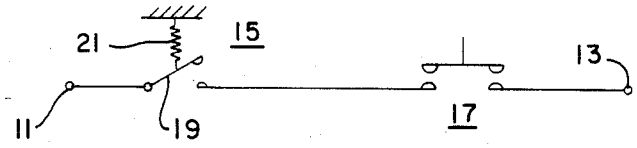
FIG. 1 PRIOR ART
FIG. 1 is a schematic view of a conventional circuit with a circuit breaker and contactor connected in series.

In FIG. 1 a traditional technology for interrupting a circuit between a line terminal 11 and a load terminal is shown schematically with a circuit breaker 15 and a contactor 17 connected in series. The circuit breaker 15 employs a movable contact arm 19 attached to a spring loaded mechanism 21 which rapidly separates contacts when a fault current triggers the mechanism. The contactor 17 is usually a magnetically operated device which does not have the capability to interrupt large currents which occur during a fault. Using the circuit breaker 15 to provide a switching function, such as in a wall panel circuit breaker board, means that the spring-loaded mechanism 21 is cycled each time the on-off function is required. This type of operation causes excessive wear on the circuit breaker mechanism and renders it inoperable in a relatively short time period of say 5,000–10,000 cycles.

Figure 2:
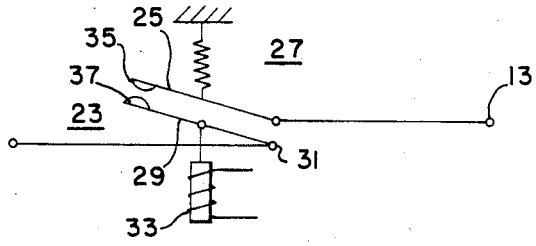
FIG. 2 is a schematic view of a magnetically operated circuit breaker in accordance with this invention.

In accordance with this invention a magnetically operated circuit breaker 23 is illustrated schematically in FIG. 2. The circuit breaker function is provided by an upper contact arm 25 of the breaker which is tied to a spring-loaded mechanism 27 in a traditional manner. In addition, a lower contact arm 29 which is pivotally mounted at 31 is controlled by an electromagnetic actuator 33, such as a solenoid. This structure enables remote control of the circuit breaker 23 by transmitting a signal from a remote source to the coil of the actuator 33, and thereby trigger a transistor or small relay (not shown) to provide power to the actuator. In this manner a very small signal from a computer controller relay can control large blocks of power.

The switching function is obtained by energizing and deenergizing the actuator 33 which either opens or closes the contacts. The lower contact arm 29 is independent of the upper arm and is not attached to the spring loaded mechanism 27. Therefore contacts 35, 37 can be opened without cycling the circuit breaker mechanism 27. The breaker 23 is able to perform the contactor function without excessive wear of the mechanism 27 that occurs when the mechanism is cycled repeatedly.

Figure 3:
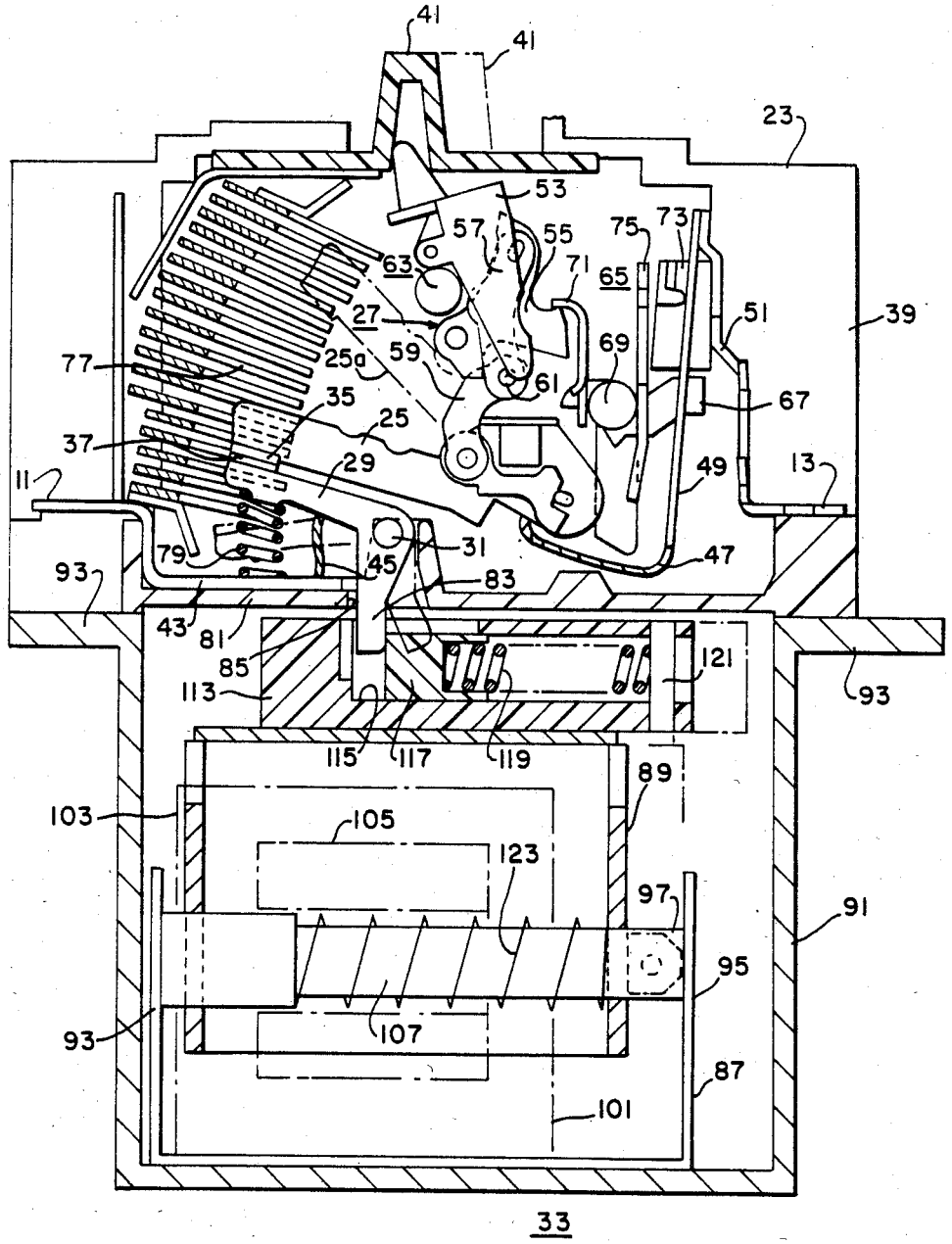
FIG. 3 is a vertical sectional view through an assembly of a circuit breaker and electromagnetic actuator.

As shown more particularly in FIG. 3 the low voltage circuit breaker 23 comprises the upper contact arm 25, actuating mechanism 27, and the lower contact arm 29. Although the circuit breaker 23 is depicted and described herein as a single phase circuit breaker, the principles of the present invention disclosed herein are equally applicable to a three phase or other polyphase circuit breakers and to both AC circuit breakers as well as DC circuit breakers.

More particularly, the circuit breaker 23 comprises a housing or case 39 having a top surface from which a handle 41 projects for manually turning the breaker between "on" and "off" positions. As shown in FIG. 3 the contacts 35, 37 are closed, whereby the circuit extends from the line terminal 11 through a conductor 43, a flexible shunt 45, lower contact arm 29, contacts 37, 35, upper contact arm 25, a flexible shunt 47, a bimetal 49, and a conductor 51 to the load terminal 13.

The spring-loaded mechanism or releasable mechanism 27 resembles similar mechanisms of traditional technology, such as disclosed in U.S. Pat. No. 4,030,060 and will not be described in detail for that reason. Generally, the mechanism 27 is an over-center toggle device which includes a metal yoke 53, a cradle or releasable arm 55, pairs of toggle links 57, 59 which are pivoted together at 61, and toggle springs (not shown) extending from the pivot pin to the upper end of the yoke 53. The lower end of the toggle link 59 is pivotally connected to the upper contact arm 25. The stop pin 63 arrests counterclockwise movement of the yoke 53 when the handle 41 is moved to the "on" position.

A trip device 65 includes the bimetal 49, a lever 67 pivoted on a pin 69, and a latch 71. A magnetic trip device including magnet 73 and armature 75 also provided in association with the bimetal 49 for rotating the lever 67 and moving the latch 71 from a latch position in conjunction with the releasable arm 55. In the open position the upper contact arm 25*a* (FIG. 3) against the stop pin 63. That position is achieved either by actuation of the trip device 65, or manual movement of the handle 41 to the broken line position. As the arm 25 moves from the closed to the open position, it moves through an arc chute 77 for extinguishing any arc occurring between the separating contacts 35, 37.

The lower contact arm 29 is normally secured in place with its contact 37 in snug electrical engagement with the contact 35 by a coil spring 79. The lower end of which engages a bottom wall 81 of the housing 39.

Moreover, the arms 25, 29 extend substantially parallel to each other in accordance with known current limiting characteristics so that any excess current above a prescribed upper limit creates opposing magnetic fields which cause the arms to separate and thereby protect the circuit breaker from excessive damage.

In accordance with this invention the lower contact arm 29, being rotatable about pivot pin 31, is a lever, such as a bell crank, having an arm portion 83 extending through an opening 85 in the bottom wall 81. In that manner the lower contact arm is in position for movement between open and closed positions by the electromagnetic actuator 33.

Figure 4:
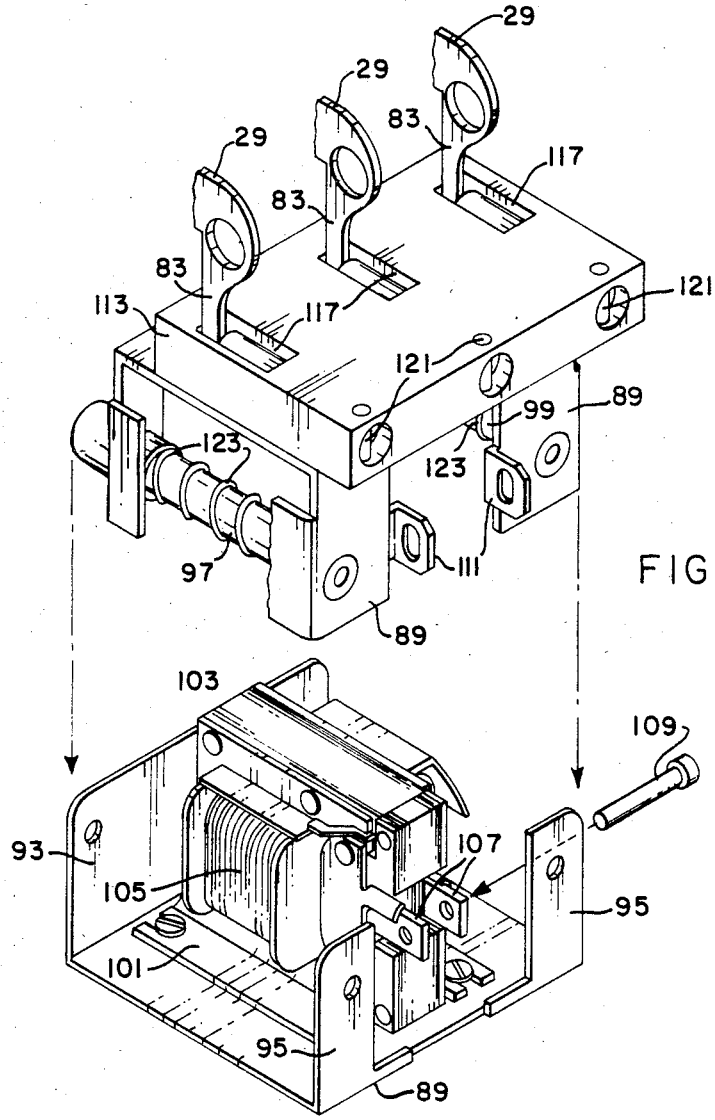
FIG. 4 is an exploded isometric view of the electromagnetic actuator indicated in FIG. 3.

The actuator 33 comprises a guide cradle 87 and a movable carriage 89 which are contained within a housing 91 which is suitably attached to the undersurface of the housing 39, such as by fastening means extending through flange 93 of the housing. The guide cradle 87 is a channel like member having upturned legs 93, 95 between which a pair of guide rails 97, 99 extend (FIGS. 3, 4). The guide cradle 87 supports an electromagnetic device, or solenoid 101, which comprises a core 103 coil winding 105 and a plunger 107. The outer end of the plunger 107 includes a pair of spaced members between which a pin 109 extends for attachment to a pair of ears 111 (FIG. 4) of the carriage 89, whereby the carriage is moved over the guide rails 97, 99.

As shown in FIGS. 3 and 4 the carriage 89 supports means for clasping or engaging the arm portion 83 for moving the lower contact arm 29 between open and closed positions. The means includes a body 113 of preferably electrically insulating material which body is secured to the upper surface of the carriage 89. The body 113 includes a cavity 115 in which a plunger 117 is slidably disposed at the end of a coil spring 119 which biases the plunger 117 against the arm portion 83. The end of the spring 119 opposite the plunger is secured in place by a retaining pin 121.

In operation, when the winding 105 is actuated, such as from a remote location, the plunger 107 moves the carriage 89 to the left, as viewed in FIGS. 3 and 4, forcing the plunger 117 against the arm portion 83 thereby closing the contacts 35, 37. When the winding 105 is deenergized, coil springs 123 on each guide rail 97, 99 move the carriage to the right, thereby moving the lower contact arm 29 to the open contact position.

When the plunger 117 presses against the lower arm portion 83, as the carriage 89 moves to the left, there is sufficient force on the contacts to achieve adequately low resistance. The coil springs 119 reduce the force required to pull the solenoid plunger 107 completely into the winding 105. The spring 119 also enables the arm portion 83 to open against the plunger 117 (and spring 79) during high current faults which produce repulsion forces between the circuit breaker arms 25, 29 as indicated above.

In conclusion, it is noted that the action of the solenoid 101 and the springs 123 may be reversed so that the contacts may be opened instead of closed by the solenoid. In such event the springs 79 and 123 would serve to move the contacts into their closed positions. Finally, as shown in FIG. 4, the circuit breaker is adaptable for use in a three-phase circuit breaker structure.

What is claimed is:

1. A magnetically operated circuit breaker comprising:

an electrically insulating housing including a bottom wall;

a circuit breaker structure within the housing and comprising first and second separable contacts operable between open and closed positions;

a releasable mechanism in an initial position and movable when released to a tripped position to effect automatic opening of the contacts;

the first contact being connected to the releasable mechanism;

the second contact being movable between open and closed positions of the first contact when the first contact is in the untripped position of the releasable mechanism;

electromagnetic actuating means for moving the second contact between open and closed positions of the first contact when untripped and in response to a control signal generated remotely from the circuit breaker;

the first and second contacts being mounted on first and second contact mounting arms, respectively, which arms extend in substantially parallel spaced locations to effect current limiting relationship between the arms;

the second contact arm being pivotally mounted for movement;

the second contact arm being within the zone of influence of the electromagnetic actuating means;

the electromagnetic actuating means comprising a solenoid having a plunger movable against the second contact arm;

the electromagnetic actuating means including an operator for moving the second contact arm and comprising a frame, and a carriage movable on the frame and an electromagnetic actuator coupled to the carriage for moving the carriage and the carriage being connected to the second contact arm to effect movement thereof between open and closed positions.

2. The circuit breaker of claim 1 in which the operator is mounted on the bottom wall of the housing, the second contact arm extending through an opening in the bottom wall, and the carriage having clasping means for clasping the contact arm.

3. The circuit breaker of claim 2 in which the electromagnetic actuating means moves the second contact arm to the contact closed position.

4. The circuit breaker of claim 3 in which the clasping means includes a pressure yielding member responsive to pressure of predetermined force resulting from a repulsion produced by any fault currents between the contact arms.

5. The circuit breaker of claim 4 in which the frame comprises guide rod means on which the carriage is slidable in response to the electromagnetic actuator, and spring bias means coupled to the carriage for retracting it upon release of the electromagnetic actuator.

6. The circuit breaker of claim 4 in which the releasable mechanism also comprises a trip device for tripping the releasable mechanism when a predetermined current overload effects deflection of the device from a latched position.

* * * * *